United States Patent [19]

Gauger

[11] 4,252,047

[45] Feb. 24, 1981

[54] ANGULARLY ADJUSTABLE FLOOR TOM STAND

[76] Inventor: Gary L. Gauger, 15108 Highland La., Minnetonka, Minn. 55343

[21] Appl. No.: 40,446

[22] Filed: May 18, 1979

Related U.S. Application Data

[63] Continuation-in-part of Ser. No. 869,915, Jan. 16, 1978, Pat. No. 4,158,980.

[51] Int. Cl.[3] ..... G10G 5/00

[52] U.S. Cl. ..... 84/421

[58] Field of Search ..... 84/421, 411 R

[56] References Cited

U.S. PATENT DOCUMENTS

| | | | |
|---|---|---|---|
| 2,433,594 | 12/1947 | Calo | 84/421 |
| 3,945,291 | 3/1976 | Zickos | 84/421 |
| 4,158,980 | 6/1979 | Gauger | 84/421 |

*Primary Examiner*—Lawrence R. Franklin

*Attorney, Agent, or Firm*—Williamson, Bains, Moore & Hansen

[57] ABSTRACT

A stand for mounting floor tom-toms consists of an arcuate member having inwardly directed flanges which have apertures therein for mounting to the lugs of the drum between the castings and the rim. Vibration-absorbing grommets are provided in the flanges in order to provide a resilient support and isolate the stand from the vibration of the drum. Brackets are provided at diametrically opposite parts of the arcuate member for clamping leg members. The stand may be adjusted for both angular and vertical position relative to the leg members.

5 Claims, 5 Drawing Figures

ANGULARLY ADJUSTABLE FLOOR TOM STAND

RELATED APPLICATIONS

This application is a continuation-in-part of Ser. No. 869,915 filed Jan. 16, 1978 now U.S. Pat. No. 4,158,980.

BRIEF SUMMARY OF THE INVENTION

In the past, floor toms have been positioned using three legs which telescopingly extend from brackets bolted to the shell of the drum. These devices suffered from several defects. First, due to location of the brackets being bolted directly to the shell of the drum, a substantial amount of vibration is transferred through the brackets down the legs to the floor. Depending upon the nature of the floor (concrete, carpet, et.), the sound quality and resonance of the drum may be substantially affected depending merely on the surface on which it is placed. Also, it is often desired to tilt the drum somewhat toward the drummer, as many musicians prefer this playing position. In order to do so, generally one of the legs is placed directly facing and adjacent to the drummer and that leg is retracted somewhat, allowing the whole drum to tilt. To do so generally requires both hands of the drummer, such that the tilting or adjustment cannot be accomplished while he is playing. Further, because of the necessity of placing the leg to be retracted adjacent the drummer, there are often conflicts between the feet of the stands of the various other pieces of the drummer's kit as the area around the drummer's right foot often tends to become very crowded. Also with the traditional floor tom stands, due to the high vibration transmitted through the legs, the drum will also have a tendency to "walk" away from the drummer during playing, requiring him to retrieve the drum, often during the middle of a song. Because the brackets mounted on the drum shell must of necessity be located near the middle of the shell, this requires the legs to be at least as long as the distance from the floor to the desired height of the drum in relation to the floor, and further as long as that distance from the bottom of the drum to the bracket. As a result, the legs are often substantially longer than the length of the drum itself, thereby requiring the legs to be removed when the drum is packed into its case, since the legs end up being longer than the case, which requires further time and effort on the part of the drummer in the setting up and taking down of his equipment.

It is therefore an object of this invention to provide a stand for a floor tom which will provide superior tonal quality, stability, the ability to quickly tilt the drum using but one hand, and the ability to pack the stand in the same case which will carry the drum. It is further an object of this invention to provide all the aforementioned features in a device which may be inexpensively and easily manufactured.

An arcuate member having a diameter slightly larger than that of a drum has a plurality of flanges attached to and directed radially, inwardly from said arcuate member. Said flanges have apertures therein which are imposed between the rim and the castings of the drum and the lugs of the drum pass therethrough in order to locate the drum relative to the bracket. Rubber grommets may be provided in the apertures for vibration isolation. Further, the apertures may be tangentially elongated to provide for some adjustability in mounting, depending upon the exact spacing of the castings and lugs of the particular drum. An arcuate member extends about the drum for an arc of roughly 150° to 230°. Ideally the member will support the drum at diametrically opposed points with some intermediate lugs being engaged to add further support and balance. The arcuate member will extend about an arc big enough to engage at least the lugs present in 180° of arc or preferably one more lug than that number (in the illustrated example, six lugs on an eight-lug drum).

Bracket plates are mounted at diametrically opposed positions on the arcuate bracket and extending therefrom are threaded studs. A D-shaped clamping member extends over the studs and is clamped in place by a threaded handle. The clamping member in turn encircles a vertical post, the post forming part of the leg member on either side. By loosening the handle, the drum and bracket may be slid vertically up and down the post member as well as pivoted about the axis formed by the two studs. The post has located at its lower end a clamping bracket which clamps thereto two foot members which may be angularly adjusted, both for storage and for avoiding conflicts with other pieces of equipment.

BRIEF DESCRIPTION OF THE DRAWING FIGURES

DESCRIPTION OF THE PREFERRED EMBODIMENT

Figure 1:
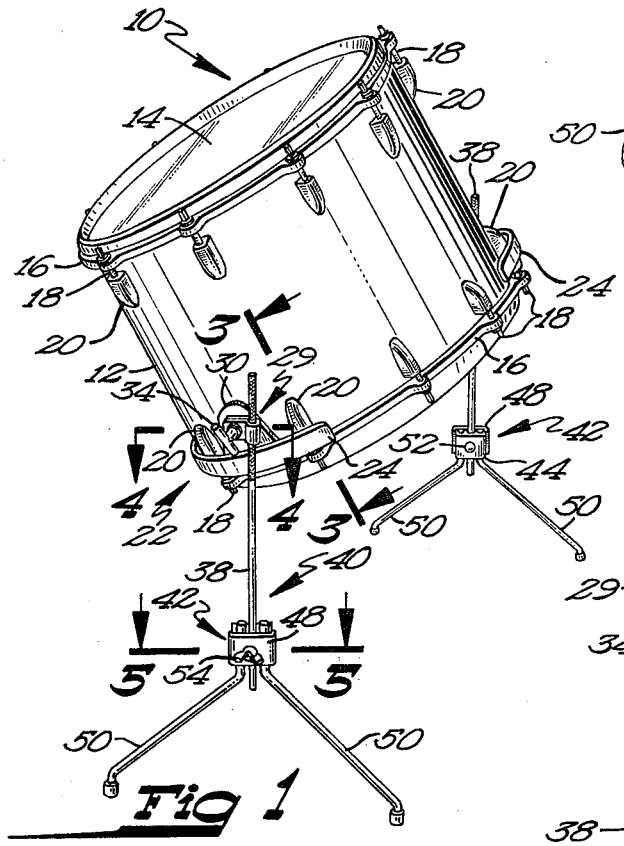
FIG. 1 is a perspective view of the instant invention.
Figure 3:
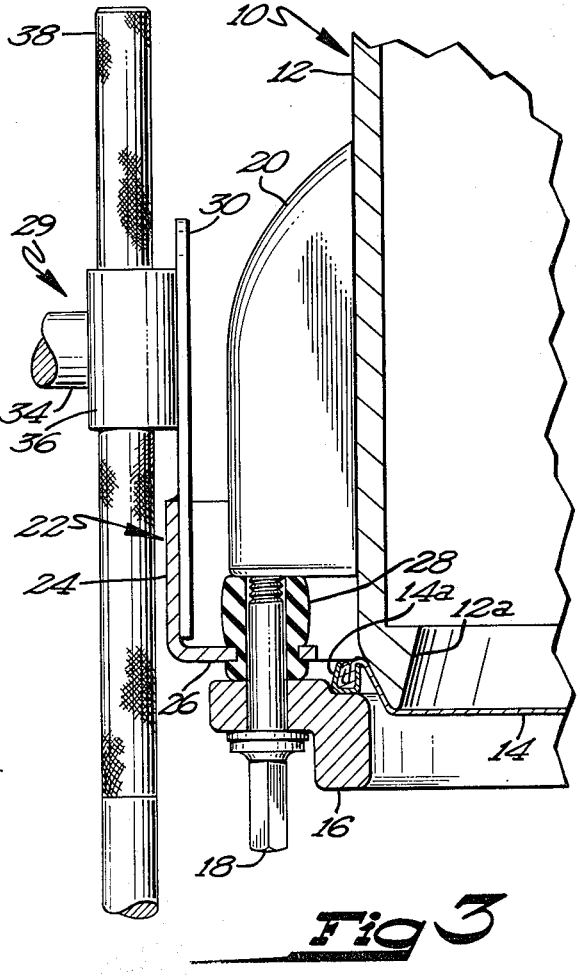
FIG. 3 is a sectional view taken along lines 3—3 of FIG. 1.

The instant invention is designed for use with a typical floor tom of the type shown particularly in FIGS. 1 and 3. The drum, generally 10, has a shell 12 with a drum head or heads 14 stretched thereover. Drum head 14 is stretched over the top edge 12A of shell 12 by rim 16 which bears on the edge 14A of drum head 14. Lugs 18 extend through rim 16 and are threaded into castings 20 which are fastened to and spaced circumferentially about shell 12, as shown in FIGS. 1 and 3.

Figure 2:
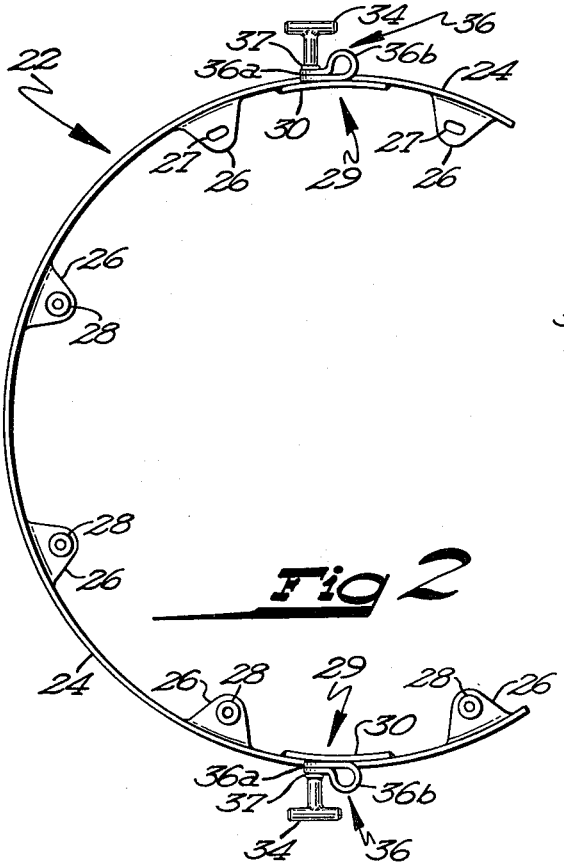
FIG. 2 is a plan view of the rim section of the instant invention.

FIG. 2 shows the rim mounting device 22. The device consists of a generally arcuate member 24 having a plurality of flanges 26 spaced circumferentially thereabout and directed radially inwardly from arcuate member 24. The spacing of flanges 26 corresponds to the spacing of lugs 18 and castings 20 about the drum. The disclosure of parent application, U.S. Ser. No. 869,915, now U.S. Pat. No. 4,158,980, is incorporated herein by reference.

As shown in FIG. 3, flanges 26 are interposed between rim 16 and castings 20 and grommets 28 are placed through flanges 26 with lugs 18 passing through grommets 28, which serves to isolate flanges 26 from any vibration present in those portions of the drum.

Figure 4:
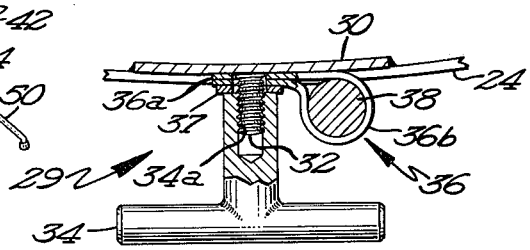
FIG. 4 is a sectional view taken along lines 4—4 of FIG. 1.

Securing assemblies 29 are located on opposite sides of arcuate member 24 by means of bolting, welding or the like, as shown in FIG. 2. In particular, securing assembly 29 is comprised of a plate member 30 which is fastened to arcuate member 24 and has a threaded stud 32 extending outwardly therefrom. A clamping member 36 is provided and is comprised of flange portions 36A and circular portion 36B. Flanged portions 36A fit over stud 32 and rounded portion 36B serves to encircle and clamp post 38 as shown in FIG. 4. A handle 34 is provided and is formed in a T-shape for ease of operation by the drummer. Handle 34 has an internal threaded portion 34A which engages stud 32, and thus when handle 34 is tightened, clamping member 36 (in conjunction with lock washer 37) serves both to prevent rotation of clamping member 36 relative to plate 30 and also to vertically secure post 38 relative to clamping member 36. Thus a single tightening of handle 34 serves to both angularly and vertically position the drum relative to the floor.

Figure 5:
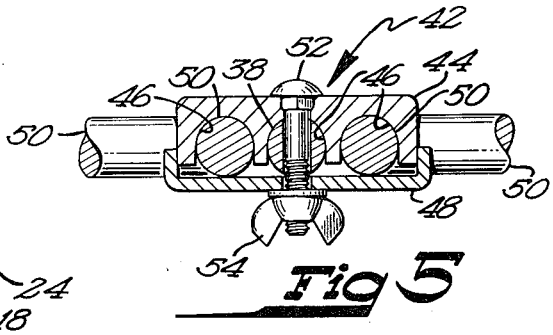
FIG. 5 is a sectional view taken along lines 5—5 of FIG. 1.

The leg assembly 40 is comprised of post 38, leg clamp assembly 42, and leg members 50 (FIGS. 1 and 5). The leg clamp assembly 42 is comprised of a channel member 44 having three slots 46 therein for location and retention of post 38 and leg members 50. A bolt 52 and wing nut 54 act in association with plate 48 to clamp and hold securely leg members 50 within channel member 44. It can be noted of course that wing nut 54 may be loosened and leg members 50 positioned in an angularly appropriate fashion so that leg members 50 do not interfere with other pieces of the drummer's kit. also, the drum may be tilted without loosening handle 34 by initially tightening handle 34 such that clamping member 36 holds post 38.

It is contemplated that various changes and modifications may be made to the stand without departing from the spirit or scope of my invention, as defined by the following claims:

What is claimed is:

1. An angularly adjustable floor tom stand for drums of the type having a cylindrical shell and a plurality of lugs comprising:

mounting means for attachment of said stand to said drum, said mounting means comprising an arcuate member having two ends and having a diameter slightly larger than the drum to be mounted thereto, said arcuate member further comprising means for engaging substantially diametrically opposed lugs of a drum and at least one lug intermediate said opposed lugs, said mounting means being free of contact with said shell;

a pair of floor engaging members; and means for slideably and pivotably securing said floor engaging members to said mounting means on substantially diametrically opposed sides of said drum.

2. An angularly adjustable floor tom stand for drums of claim 1 wherein said securing means comprises:

a clamping member clampingly engaging each of said floor engaging members; and means for tightening each of said clamping members, said tightening means also acting to prevent the rotation of said clamping member relative to said mounting means.

3. An angularly adjustable floor tom stand for drums of claim 2 wherein said clamping means comprises:

a clamping member having an arcuate portion encircling said floor engaging member and two flange portions depending from said arcuate portion, each of said flange portions having an aperture therein;

and wherein said tightening means comprises a stud extending outwardly from said mounting means, said stud passing through said apertures; and means located on said stud opposite said mounting means for forcing said flange portions together and against said mounting means in frictional engagement.

4. An angularly adjustable floor tom stand for drums of claim 1 wherein each of said floor engaging members comprises:

a substantially vertical post in engagement with said securing means; and a pair of legs depending from said post and engaging the floor to provide four-point support.

5. An angularly adjustable floor tom stand for drums of claim 4 wherein said legs are pivotably attached to said post.

* * * * *